US007086183B2

(12) United States Patent
Wood et al.

(10) Patent No.: US 7,086,183 B2
(45) Date of Patent: Aug. 8, 2006

(54) CLEATED ARTICLE OF FOOTWEAR

(75) Inventors: Thomas Wood, Foxborough, MA (US); Jared Goldman, Natick, MA (US); Michael Kratochwill, Mansfield, MA (US)

(73) Assignee: Reebok International Ltd., Canton, MA (US)

( * ) Notice: Subject to any disclaimer, the term of this patent is extended or adjusted under 35 U.S.C. 154(b) by 85 days.

(21) Appl. No.: 10/900,271

(22) Filed: Jul. 28, 2004

(65) Prior Publication Data

US 2006/0021259 A1 Feb. 2, 2006

(51) Int. Cl.
*A43B 5/02* (2006.01)

(52) U.S. Cl. ..... 36/128; 36/134; 36/67 D; 36/59 C

(58) Field of Classification Search ..... 36/128, 36/134, 67 A, 67 D, 59 C, 59 R; D2/962, D2/955
See application file for complete search history.

(56) References Cited

U.S. PATENT DOCUMENTS

| | | | | | |
|---|---|---|---|---|---|
| D35,330 | S | * | 11/1901 | Whitaker | D30/150 |
| 2,582,053 | A | * | 1/1952 | Merlin | 36/59 R |
| D234,013 | S | * | 12/1974 | Lamarche et al. | D2/955 |
| 4,107,858 | A | | 8/1978 | Bowerman et al. | |
| 4,233,759 | A | | 11/1980 | Bente et al. | |
| 4,492,047 | A | | 1/1985 | Arff | |
| 4,586,274 | A | | 5/1986 | Blair | |
| 4,698,923 | A | | 10/1987 | Arff | |
| D366,755 | S | | 2/1996 | Abbey | |
| D375,192 | S | * | 11/1996 | Bathum | D2/962 |
| 5,572,807 | A | | 11/1996 | Kelly et al. | |
| 5,655,317 | A | | 8/1997 | Grant | |
| D390,693 | S | | 2/1998 | Curley, Jr. | |
| D392,451 | S | | 3/1998 | Collins et al. | |
| D402,800 | S | | 12/1998 | Santos et al. | |
| D402,801 | S | | 12/1998 | Santos et al. | |
| 5,887,371 | A | | 3/1999 | Curley, Jr. | |
| 5,906,059 | A | | 5/1999 | Singer et al. | |
| D412,240 | S | | 7/1999 | Todd | |
| 5,943,794 | A | | 8/1999 | Gelsomini | |
| 5,996,260 | A | | 12/1999 | MacNeill | |
| 6,009,640 | A | | 1/2000 | Deacon et al. | |
| 6,052,923 | A | | 4/2000 | McMullin | |
| D424,384 | S | | 5/2000 | Singer | |
| 6,138,386 | A | | 10/2000 | Singer et al. | |
| 6,154,984 | A | | 12/2000 | Adam | |
| 6,233,850 | B1 | | 5/2001 | Peabody | |
| 6,305,104 | B1 | | 10/2001 | McMullin | |
| 6,327,797 | B1 | * | 12/2001 | Deacon et al. | 36/127 |
| D454,681 | S | | 3/2002 | Duval | |
| 6,381,878 | B1 | | 5/2002 | Kennedy, III et al. | |
| 6,463,682 | B1 | | 10/2002 | Carroll, Jr. | |
| 6,467,196 | B1 | | 10/2002 | Koyama | |
| D513,359 | S | * | 1/2006 | McMullin | D2/962 |

* cited by examiner

*Primary Examiner*—Ted Kavanaugh
(74) *Attorney, Agent, or Firm*—Sterne Kessler Goldstein Fox PLLC.

(57) ABSTRACT

This application is directed towards an article of footwear for deeply and quickly penetrating a turf surface, such as a soccer, rugby or football shoe. The article of footwear includes a cleat having fluted sides, which creates a channel for moving turf materials in a direction different from the direction of penetration for faster and deeper cleat penetration and better traction. The application also is directed towards an individual cleat for a shoe, wherein the cleat has fluted sides.

34 Claims, 6 Drawing Sheets

CLEATED ARTICLE OF FOOTWEAR

FIELD OF THE INVENTION

The present invention relates generally to an article of footwear having a cleat thereon and the cleat attached thereto.

BACKGROUND OF THE INVENTION

In a variety of sports, traction on a playing field is improved by wearing a cleated shoe. Many spiked shoes, such as those metal and plastic spikes made for golf shoes, provide only surface traction and do not penetrate deeply into turf surfaces for traction, so as not to cause damage to delicate golf courses and greens. A golf shoe of this type may be found in U.S. Pat. No. 5,906,059 to Singer et al. For running sports and sports played in a variety of weather conditions, such as football, rugby and soccer, where surface traction alone will not provide adequate traction, cleated shoes have been developed to penetrate more deeply than the surface traction provided by golf shoes. Slippery turf conditions may be caused by the weather, the type of turf, and the particular activity being performed on the turf surface. For each of these slippery conditions, traction is enhanced when cleats can penetrate deeply and quickly into a turf surface.

To solve this problem, many cleats have been created in a conical shape, with a smaller surface area at a tip so that the smaller surface area can penetrate the surface more easily. However, as the cleat pushes down into a grass or synthetic turf, the turf is compacted underneath the cleat or is forced away from the sloped sides of the cleat. As the dirt compacts, resistance to the penetration of the cleat is created thus inhibiting the cleat from quickly and deeply penetrating the turf.

BRIEF SUMMARY OF THE INVENTION

The present invention is directed towards an article of footwear including a cleat having fluted sides. The fluted sides provide a channel for moving turf materials in a direction different from the direction of penetration for faster and deeper cleat penetration and better traction.

Another aspect of the invention is an individual cleat for a shoe, wherein the cleat has fluted sides.

Further embodiments, features, and advantages of the present invention, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

Figure 9A:
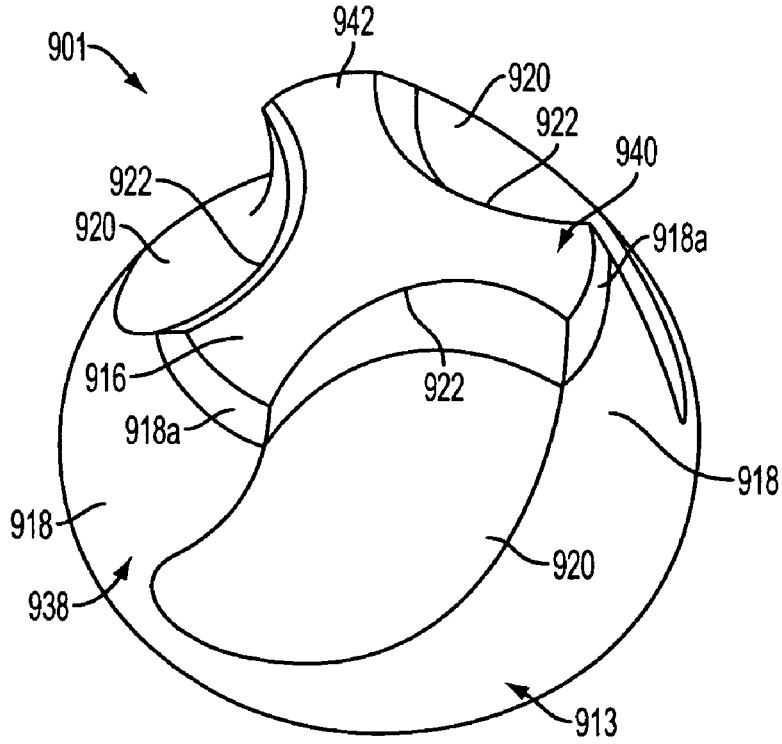
Figure 9B:
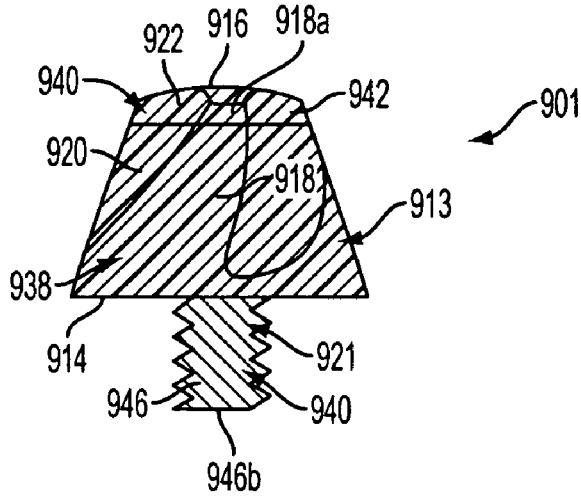
Figure 9C:
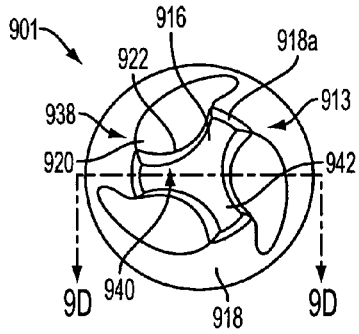
Figure 9D:
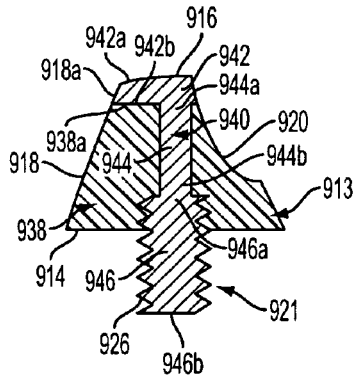

FIG. 9A is a perspective view of an embodiment of a cleat of the present invention. FIG. 9B is a side plan view of the cleat of FIG. 9A. FIG. 9C is a top plan view of the cleat of FIG. 9A. FIG. 9D is a cross-sectional view of the cleat of FIG. 9A taken along line D—D of FIG. 9C.

The present invention will be described with reference to the accompanying drawings. The drawing in which an element first appears is typically indicated by the leftmost digit(s) in the corresponding reference number.

DETAILED DESCRIPTION OF THE INVENTION

The present invention is directed toward a cleated shoe, particularly a cleated shoe designed for deep and fast penetration into a turf surface, such as would be necessary in shoes for football, rugby or soccer. Many sports are played on a variety of turf surfaces, both natural, synthetic and combination of natural and synthetic turf surfaces. Some non-exclusive examples of turf surfaces include any type of natural grass, Astroturf, FIELD TURF, and those turf surfaces particularly used in professional or collegiate football, soccer or rugby fields.

Figure 1:
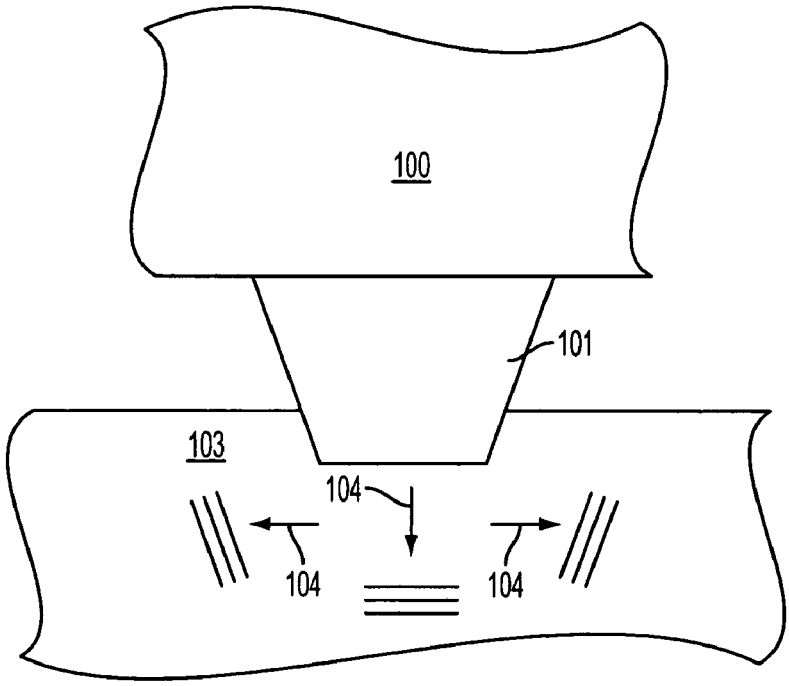
FIG. 1 PRIOR ART
FIG. 1 is a partial cross-sectional view of a conical shaped cleat penetrating a turf surface.

FIG. 1 illustrates the manner in which a conventional conical cleat 101 of a shoe 100 penetrates a turf surface 103. Arrows 104 illustrate the direction of the force and the way the soil or other material that form the turf surface 103 are compacted as the cleat 101 is pushed downward. As the soil or other material compacts, it creates a resistance to the cleat pushing further downward, thus slowing or limiting the ability of the cleat to embed in the turf surface.

Figure 2:
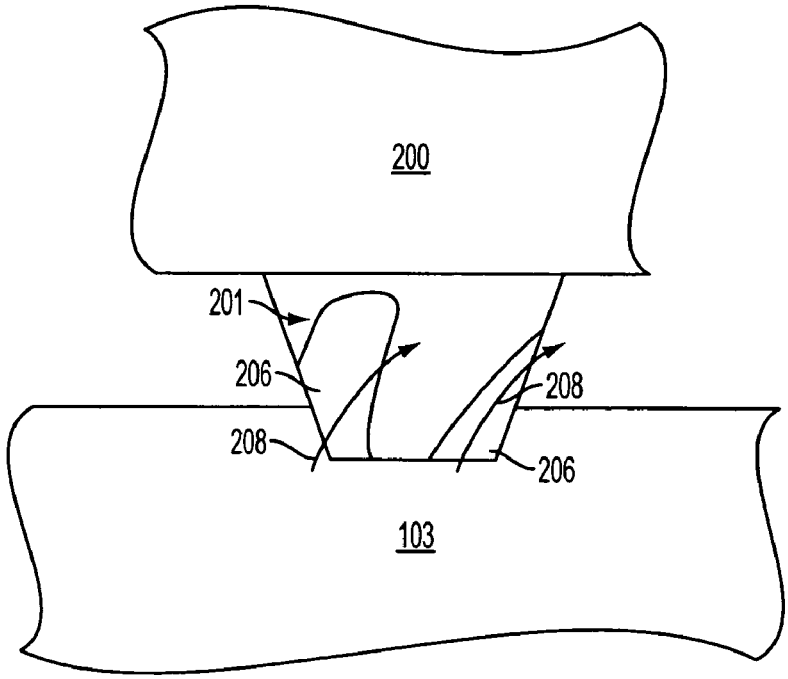
FIG. 2 is partial cross-sectional view of an embodiment of a cleat of the present invention penetrating a turf surface.

FIG. 2 illustrates a cleat 201 of a shoe 200 according to the present invention penetrating a turf surface 103. Cleat 201 includes fluting 206 that channels at least some soil or other turf materials generally in the direction of arrows 208, moving soil or other turf materials without as much compacting as with conventional cleat 101. As such, cleat 201 penetrates the turf surface deeper and faster to increase traction of shoe 200.

Figure 3:
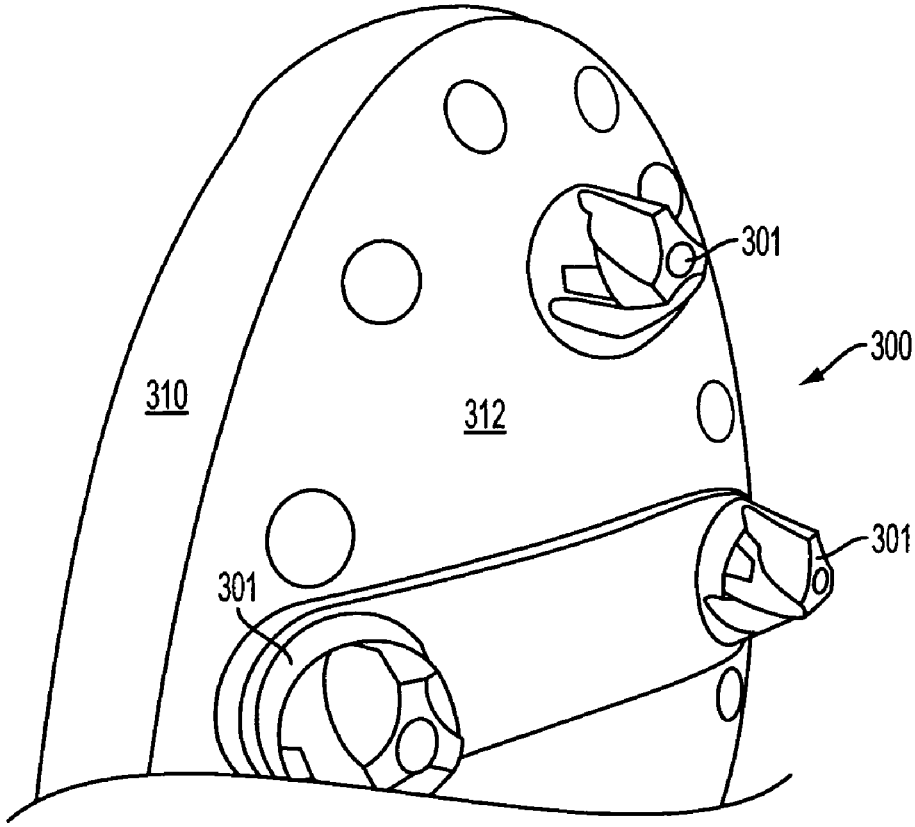
FIG. 3 is a bottom perspective view of an embodiment of a cleated shoe of the present invention

FIG. 3 illustrates a shoe 300, including an upper 310 and a sole 312, attached to the upper, and at least three cleats 301, such as the cleats described or otherwise disclosed herein. Shoe 300 illustrates the general environment for which any cleat of the present invention may be suitable. Shoe 300 may have any number of cleats 301 disposed anywhere on sole 312. Each of cleats 301 may be permanent or may be detachable. If cleat 301 is permanent, it may be formed integrally with sole 312, formed integrally with an intermediate element (not shown) of a sole 312, or formed separately and subsequently permanently attached to sole 312 or an intermediate element thereof.

Figure 4A:
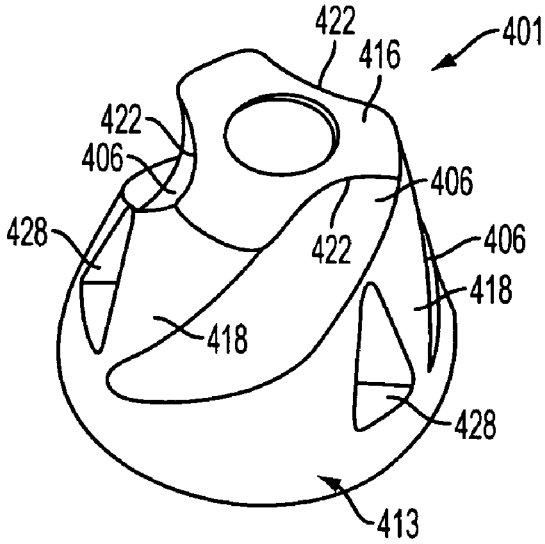
FIG. 4A is a perspective view of an embodiment of a cleat of the present invention.
Figure 4B:
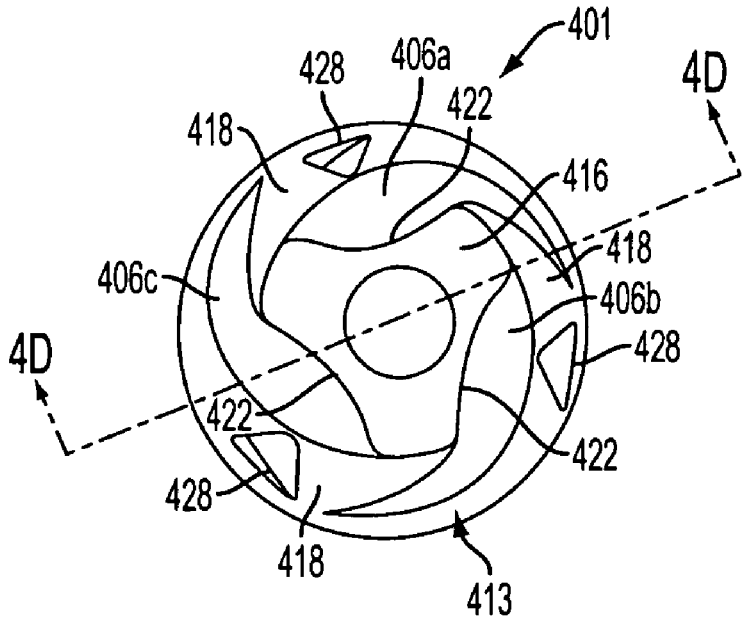
FIG. 4B is a top plan view of the cleat of FIG. 4A.

FIGS. 4A–4D illustrate a cleat 401 according to an embodiment of the present invention. Cleat 401 includes a head 413 which is generally a conical frustum, or a three-dimensional cone which has had the point cut off. Head 413 of cleat 401, has a generally circular base end 414 and a tip end 416. Base end 414 of head 413 abuts a sole of a shoe, such as sole 312 of shoe 300 of FIG. 3, and tip end 416 is capable of penetrating a turf surface. Head 413 also has sloping sides 418. Sloping sides 418 have fluting 406 therein. Fluting 406 are grooves or channels formed in an otherwise conical frustum that spiral around the cleat 401 as it extends from tip end 416 towards base end 414 of head 413. As best shown in FIG. 4B, cleat 401 has three fluted regions 406*a*, 406*b* and 406*c*, which form circumferentially-spaced spirals around sloping sides 418 of cleat 401.

The base end 414 has a first surface area which is larger than a second surface area of the tip end 416, such that the tip end 416 may easily enter a turf surface. The first surface area of base end 414 may be about one-half inch to about three-quarters inch in diameter, which is generally smaller than a base of a typical golf spike. The second surface area of tip end 416 may be about one-quarter inch to about one-half inch in diameter. Tip end 416 is generally flat, but may be slightly curved towards the sloping sides 418 of head 413.

Figure 4C:
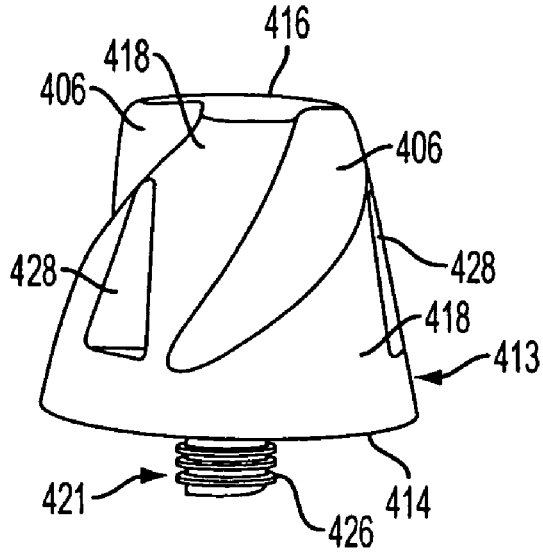
FIG. 4C is a side plan view of the cleat of FIG. 4A.
Figure 4D:
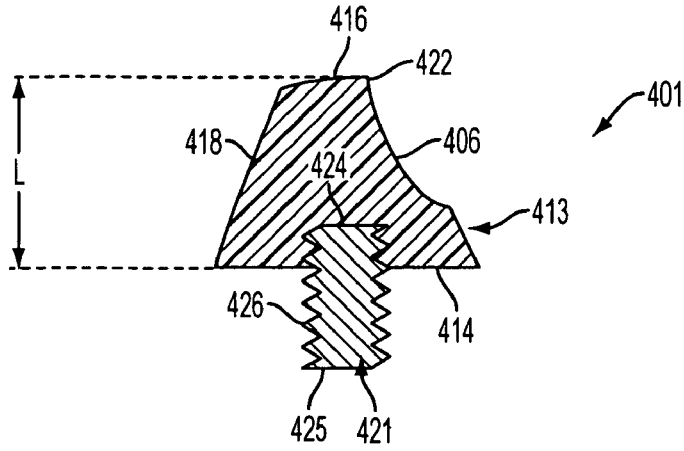
FIG. 4D is a cross-sectional view of the cleat of FIG. 4A taken along line D—D of FIG. 4B.

The surface area of tip end 416 is made even smaller where fluting 406 extending through to the tip end 416 has formed cut outs 422 in the tip end 416, which otherwise would be a circular end to a conical frustum. As such, tip end 416 is generally Y-shaped. Although the surface area of tip end 416 is sufficiently reduced to allow for the turf penetration as discussed above, it is not reduced enough to penetrate the skin of a player. As shown in FIG. 4D, cleat 401 includes a length L, that is the distance between the tip end 416 and base end 414. Fluting 406 is deepest at the tip end 416 and gradually becomes more shallow as fluting 406 spirals along length L towards the base end 414, so as to provide a channel to move soil or other turf materials while cleat 401 is penetrating the turf surface.

A detachable cleat 401 may also include a fastener for coupling cleat 401 to a sole of a shoe, such as sole 312 of shoe 300 of FIG. 3. An example of such a fastener is a post 421, as seen in FIGS. 4C and 4D. Post 421 has a first end 424 embedded within head 413 of cleat 401 and a second end 425 that extends from base end 414 of head 413. Post 421 includes an exterior surface with a first set of threads 426. Threads 426 correspond to and are capable of engaging a second set of threads (not shown) which are formed on an interior surface of a recess formed in a sole of a shoe, such as sole 312 of shoe 300 of FIG. 3. Other fasteners may include, but are not limited to clips, pins, retaining rings, rivets, brads, brackets, or another fastener apparent to one skilled in the art.

In one embodiment, such a sole recess (not shown), may include an insert (not shown) when the material that a sole is made of is flexible or not strong enough to support the force of the traction created by cleat 401. Post 421 is generally a strong and inflexible material, including but not limited to metals, such as steel, stainless steel, nickel, copper, chromium, iron, brass, bronze, aluminum, titanium, magnesium or a combination or an alloy thereof, so as to maintain its connection with a sole of a shoe. However, post 421 may also be made of a strong thermoplastic material, including but not limited to nylon or silicone. Head 413 of cleat 401 may be made from a metal or plastic material that, preferably, will not chip, break or crush. Such materials may be, but are not limited to, metal or thermoplastic materials, such as a material including thermoplastic polyurethane (TPU) or PEBAX. Head 413 and/or post 421, if made of a thermoplastic material, may be injection molded, blow molded, thermoformed, or formed by another method for molding thermoplastics that would be apparent to one skilled in the art. In the embodiment shown in FIGS. 4A–4D, an injection molded TPU head 413 is formed over and around a first end 424 of a steel post 421. In an alternate embodiment, post 421 may be subsequently screwed into a previously formed head 413 via formed threads or another bore formed therein.

In one embodiment, a detachable cleat 401 may also include notches 428 in head 413. Notches 428 engage a connecting tool (not shown) used to fasten and unfasten cleat 401 to a sole of a shoe, such as sole 312 of shoe 300. Cleat 401, as illustrated in FIGS. 4A–4D, includes three circumferentially-spaced notches 428 along sloping sides 418 of head 413. Thus, a connecting tool, would have three prongs which engage notches 428 to aid in turning and tightening post 421 into a recess of a sole of a shoe. In alternate embodiments, cleat 401 may have greater or fewer number of notches 428, as would appropriately correspond to a connecting tool. Further, cleat 401 has notches 428 which are generally triangular ridges which become deeper as they extend in a direction away from tip end 416 and towards base end 414. Notches 428 may be shaped differently such as a circular well in head 413 or another shape as would be apparent to one skilled in the art, provided that it corresponds to an similarly shaped connecting tool.

Length L of cleat 401 from FIG. 4D is significantly long enough to embed deeply into a turf surface for good traction. For example, a length between about one-half to one inch is suitable for most applications. However, since NCAA rules presently require cleats no longer than one-half inch, cleat 401 may be shorter than one-half inch, such as about three-eighths inch, but longer than the length of a typical golf spike, which will not embed deeply into a turf surface, but merely provide surface traction.

Figure 5:
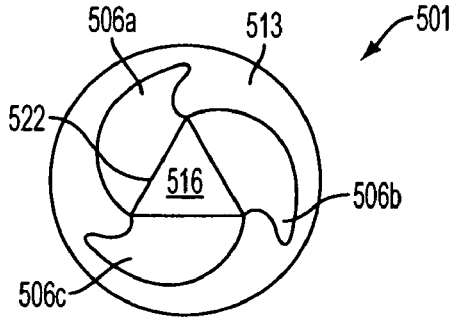
FIGS. 5–8 are top plan views of alternate embodiments of cleats of the present invention.
Figure 6:
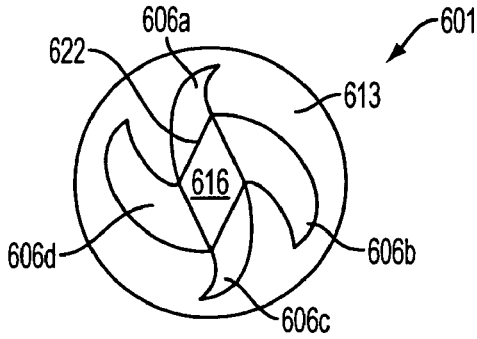
Figure 7:
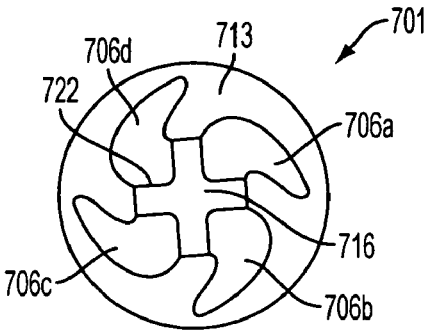
Figure 8:
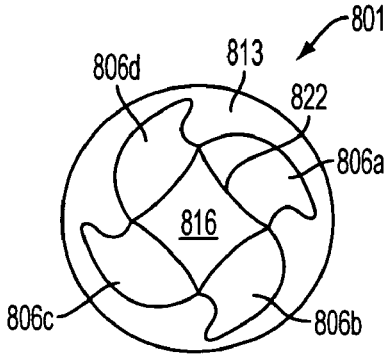

As discussed above, FIG. 4B illustrates how three fluted regions, 406*a*. 406*b* and 406*c* form a Y-shaped tip end 416. However, alternate embodiments may have a different shaped tip end and more or less fluted regions. FIGS. 5–8 illustrate some, but not all, of these alternate embodiments. In particular, FIG. 5 illustrates a cleat 501 having a head 513 with three fluted regions 506*a*, 506*b* and 506*c*, which form straight rather than curved cut outs 522 to form a triangular-shaped tip end 516. Similarly, FIG. 6 illustrates a cleat 601 having a head 613 with four fluted regions 606*a*, 606*b*, 606*c* and 606*d* which form four straight cut outs 622 to form a diamond-shaped tip end 616. FIG. 7 illustrates a cleat 701 having a head 713 with four fluted regions 706*a*, 706*b*, 706*c* and 706*d* which form four right angle curved cut outs 722 to form a plus (+)-shaped tip end 716. FIG. 8 illustrates a cleat 801 having a head 813 with four fluted regions 806*a*, 806*b*, 806*c* and 806*d* which form four curved cut outs 822, similar to cut outs 422 of FIGS. 4A–4D, to form a four pointed star-shaped tip end 816. These alternative embodiments are merely illustrative examples of the possible shapes of a tip end according to further embodiments of the present invention, when the number and cut outs of fluted regions are altered.

FIGS. 9A–9D show an alternative embodiment of a cleat 901. Cleat 901 is shaped and functions similarly to cleat 401 of FIGS. 4A–4D, including a head 913 and a fastener, post 921. However, head 913 is made of two different materials instead of just one material, as shown in FIGS. 4A–4D. In particular, head 913 includes a plastic portion 938 and a metal portion 940. The plastic portion 938 may be a thermoplastic material, such as TPU or PEBAX. Metal portion 940 may be made from a metal, such as steel, stainless steel, nickel, copper, chromium, iron, brass, bronze, aluminum, titanium, magnesium or a combination or an alloy thereof.

Having metal portion 940 and plastic portion 938 provides cleat 901 with the combination of strength and durability of a metal part with the lightweight of a thermoplastic part. Metal portion 940 includes a tip portion 942, which has a first end 942*a* that defines a tip end 916 of head 913. Tip portion 942 also includes sides which define a portion 918*a* of sloping sides 918 and cut outs 922 formed by fluting 906. Tip portion 942 also includes a second end 942*b*, which is flush with a first end 938*a* of plastic portion 938. A metallic tip portion 942 gives cleat 901 exceptional durability, in that the tip end 916 most often contacts not only the turf of playing surfaces, but also concrete and other walking surfaces. Second end 942*b* of tip portion 942 engages a first end 944*a* of an extension portion 944. Extension portion 944 extends through a center of head 913 of cleat 901, providing support and strength to cleat 901. Extension portion 944 includes a second end 944*b* which engages a first end 946*a* of a fastening portion 946. Fastening portion 946 also includes a second end 946*b*, which extends from a base end 914 of head 913. Fastening portion 946 defines post 921 and includes an outer surface with a first set of threads 926. Threads 926 correspond to and are capable of engaging a second set of threads (not shown) which are formed on an interior surface of a recess formed in a sole of a shoe, such as sole 312 of shoe 300 of FIG. 3. Having metal portion 940 extend through the length of cleat 901 also ensures that cleat 901 fastens securely to a sole of a shoe in that post 921 is part of metal portion 940 that is secured within the entire length of cleat 901. As with cleat 401, discussed above, a metal tipped cleat, such as cleat 901, may be permanently attached or detachable with a sole and may utilize any type of fastening means.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

Additionally, all references cited herein, including issued U.S. patents, or any other references, are each entirely incorporated by reference herein, including all data, tables, figures, and text presented in the cited references.

What is claimed is:

1. An article of footwear, comprising:

an upper; and a sole attached to said upper, said sole including at least one cleat;

wherein said cleat includes a head, having a base end with a first surface area, a tip end opposite said base end with a second surface area that is less than said first surface area of said base end and substantially sloping sides, said base end abutting said sole; and wherein said tip end and said sloping sides include at least one flute, wherein said flute is deepest at said tip end and gradually becomes more shallow and spirals around said head as it extends from said tip end towards said base end and wherein said fluting is capable of directing said cleat deep into a turf surface.

2. The article of footwear of claim 1, wherein said head includes three fluted regions circumferentially spaced around said head.

3. The article of footwear of claim 2, wherein said head forms three circumferentially spaced cut outs in said tip end.

4. The article of footwear of claim 1, wherein said cleat is formed integrally with said sole.

5. The article of footwear of claim 1, wherein said cleat is detachable.

6. The article of footwear of claim 5, wherein said cleat includes at least one notch, said notch being capable of engaging a connecting tool.

7. The article of footwear of claim 5, wherein said cleat includes a fastener having a first end coupled to said head and a second end coupled to said sole.

8. The article of footwear of claim 7, wherein said fastener is a post, wherein said first end is embedded into said head and said second end extends from said base end of said head and engages said sole.

9. The article of footwear of claim 8, wherein said post includes an outer surface having a first set of threads, and said sole includes a recess, wherein said recess has an inner surface with a second set of threads capable of engaging said first set of threads.

10. The article of footwear of claim 1, wherein said head is formed from one of a thermoplastic polyurethane or PEBAX.

11. The article of footwear of claim 1, wherein said head is formed with a first plastic section and a second metal section, wherein said second metal section includes at least a tip portion defining at least said tip end of said head.

12. The article of footwear of claim 11, wherein said second metal section further includes an extension portion having a first end engaging said tip portion and a second end extending from said tip portion through a center of said head, and a fastening portion having a first end engaging said extension portion and a second end extending from said base end of said head.

13. The article of footwear of claim 12, wherein said cleat is detachable and said fastening portion includes an outer surface having a first set of threads and wherein said sole includes at least one recess, said recess including an inner surface having a second set of threads that are capable of engaging said first set of threads.

14. The article of footwear of claim 1, wherein said tip end is generally flat.

15. The article of footwear of claim 1, wherein a distance between said base end and said tip end is about three-eighths inch to about three-quarters inch.

16. The article of footwear of claim 1, wherein said base end is about one-half inch to about three-quarters inch in diameter.

17. The article of footwear of claim 1, wherein said tip end is about one-quarter inch to about one-half inch in diameter.

18. A cleat for a shoe, comprising:

a head having a base end with a first surface area, a tip end with a second surface area that is less than said first surface area and substantially sloping sides, wherein said base end is capable of abutting a sole of a shoe and said tip end is capable of embedding into a turf surface;

wherein said tip end and sloping sides of said head include fluting, wherein the fluting is deepest at said tip end and becomes more shallow and spirals around said head as it extends from said tip end towards said base end; and wherein said tip end is generally flat.

19. The cleat of claim 18, wherein said fluting includes three fluted regions circumferentially-spaced around said head.

20. The cleat of claim 19, wherein said fluting forms three circumferentially spaced cut outs in said tip end.

21. The cleat of claim 18, wherein said cleat is detachable.

22. The cleat of claim 21, wherein said head includes at least one notch, said notch being capable of engaging a connecting tool.

23. The cleat of claim 18, further comprising a fastener.

24. The cleat of claim 23, wherein said fastener is a post, wherein a first end of said post is embedded into said head and a second end of said post extends from said base end of said head.

25. The cleat of claim 24, wherein said post includes an outer surface having a first set of threads, which are capable of engaging a second set of threads.

26. The cleat of claim 18, wherein said head is formed from one of a thermoplastic polyurethane or PEBAX.

27. The cleat of claim 18, wherein said head is formed with a first plastic section and a second metal section, wherein said second metal section includes at least a tip portion defining at least said tip end of said head.

28. The cleat of claim 27, wherein said second metal section further includes an extension portion having a first end engaging said tip portion and a second end extending from said tip portion through a center of said head, and a fastening portion having a first end engaging said extension portion and a second end extending from said base end of said head.

29. The cleat of claim 28, wherein said cleat is detachable and said fastening portion includes an outer surface having a first set of threads that are capable of engaging a second set of threads.

30. The cleat of claim 18, wherein said tip end is generally flat.

31. The cleat of claim 18, wherein a distance between said base end and said tip end is about three-eighths inch to about three-quarters inch.

32. The cleat of claim 18, wherein said base end is about one-half inch to about three-quarters inch in diameter.

33. The cleat of claim 18, wherein said tip end is about one-quarter inch to about one-half inch in diameter.

34. An article of footwear, comprising:

an upper; and a sole attached to said upper, said sole including at least one cleat;

wherein said cleat includes a head, having a base end with a first surface area, a tip end opposite said base end with a second surface area that is less than said first surface area of said base end and substantially sloping sides, said base end abutting said sole;

wherein said tip end and said sloping sides include fluting, wherein the fluting is deepest at said tip end and gradually becomes more shallow and spirals around said head as it extends from said tip end towards said base end and wherein said fluting is capable of directing said cleat deep into a turf surface; and wherein said article of footwear is not a golf shoe.

* * * * *